US012163690B2

(12) United States Patent
Goto et al.

(10) Patent No.: US 12,163,690 B2
(45) Date of Patent: Dec. 10, 2024

(54) INDOOR UNIT OF AIR-CONDITIONING APPARATUS

(71) Applicant: Mitsubishi Electric Corporation, Tokyo (JP)

(72) Inventors: Takuya Goto, Tokyo (JP); Yasushi Oba, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 710 days.

(21) Appl. No.: 17/295,912

(22) PCT Filed: Jan. 30, 2019

(86) PCT No.: PCT/JP2019/003117
§ 371 (c)(1),
(2) Date: May 21, 2021

(87) PCT Pub. No.: WO2020/157850
PCT Pub. Date: Aug. 6, 2020

(65) Prior Publication Data

US 2022/0026104 A1 Jan. 27, 2022

(51) Int. Cl.
*F24F 13/20* (2006.01)

(52) U.S. Cl.
CPC ..... *F24F 13/20* (2013.01)

(58) Field of Classification Search
CPC ..... F24F 13/20
USPC ..... 454/367
See application file for complete search history.

(56) References Cited

U.S. PATENT DOCUMENTS

| | | | | |
|---|---|---|---|---|
| 10,962,239 | B2 * | 3/2021 | Watanabe | F24F 1/22 |
| 2015/0016808 | A1 | 1/2015 | Yamaguchi et al. | |
| 2016/0363328 | A1 | 12/2016 | Okamoto et al. | |
| 2016/0363343 | A1 | 12/2016 | Okamoto et al. | |
| 2017/0254547 | A1 | 9/2017 | Okamoto et al. | |

(Continued)

FOREIGN PATENT DOCUMENTS

| | | | |
|---|---|---|---|
| JP | 2005-090773 | A | 4/2005 |
| JP | 2015-031480 | A | 2/2015 |

(Continued)

OTHER PUBLICATIONS

International Search Report dated Mar. 5, 2019, issued in corresponding International Application No. PCT/JP2019/003117.

(Continued)

*Primary Examiner* — Avinash A Savani
*Assistant Examiner* — Dana K Tighe
(74) *Attorney, Agent, or Firm* — Posz Law Group, PLC

(57) ABSTRACT

An indoor unit includes a rear housing in which a heat exchanger and an electrical component box are disposed, a front housing disposed in front of the heat exchanger such that the front housing is removable, a front design panel disposed in front of the front housing such that the front design panel is removable, a securing and storage part into which a communication adapter is secured, and a temporary placement part for the communication adapter. The securing and storage part is disposed in the front housing such that the securing and storage part is exposed when the front design panel is removed. The temporary placement part is used to temporarily place the communication adapter on the temporary placement part.

5 Claims, 15 Drawing Sheets

(56) References Cited

U.S. PATENT DOCUMENTS

| | | | | |
|---|---|---|---|---|
| 2017/0261224 | A1 | 9/2017 | Okamoto et al. | |
| 2020/0224923 | A1 * | 7/2020 | Suehiro | F24F 5/0003 |

FOREIGN PATENT DOCUMENTS

| | | | | |
|---|---|---|---|---|
| JP | 2015-124976 | A | 7/2015 | |
| JP | 2016-121833 | A | 7/2016 | |
| WO | 2013/121920 | A1 | 8/2013 | |
| WO | WO-2019142352 | A1 * | 7/2019 | F24F 13/20 |

OTHER PUBLICATIONS

Office Action dated Aug. 18, 2023 issued in corresponding German Patent Application No. 112019006774.5 (and English translation).

* cited by examiner

INDOOR UNIT OF AIR-CONDITIONING APPARATUS

CROSS REFERENCE TO RELATED APPLICATION

This application is a U.S. National Stage Application of International Application No. PCT/JP2019/003117, filed on Jan. 30, 2019, the contents of which are incorporated herein by reference.

TECHNICAL FIELD

The present disclosure relates to a support structure for supporting a communication adapter of an indoor unit of an air-conditioning apparatus.

BACKGROUND ART

Some indoor units used for air-conditioning apparatuses include a built-in wireless communication adapter. The communication adapter is connected by a cable to a controller disposed in an electrical component box. Such an indoor unit is remotely operated through communication with an external device via the communication adapter. In an indoor unit disclosed in Patent Literature 1, the front portion of a front grille has a box-shaped storage part that is open at the front. The storage part is disposed near an electrical component box. A communication adapter is stored into the storage part. A harness, that is, a communication cable is connected to the communication adapter. The communication cable is routed to the interior of the electrical component box through an opening provided in a service lid of the electrical component box, and is connected to a control board mounted inside the electrical component box.

CITATION LIST

Patent Literature

Patent Literature 1: Japanese Unexamined Patent Application Publication No. 2016-121833

SUMMARY OF INVENTION

Technical Problem

In the indoor unit described in Patent Literature 1; the storage part for the communication adapter is disposed adjacent to the electrical component box, and movement of the communication cable is restricted by the outer periphery edge of the opening provided in the service lid. This means that during maintenance, after removing the communication adapter stored in the storage part, a user or service person is unable to freely pick up the communication adapter in their hand as the communication adapter is pulled by the communication cable. This makes it difficult for the user or service person to check information written on the outside of the communication adapter; and set up the communication adapter. There exists therefore a need for improved ease of operation. In this regard, it may be conceivable to increase the length of the communication cable somewhat to allow the user or service person to remove the communication adapter from the storage part and freely pick up the communication adapter in their hand. A problem with increasing the length of the communication cable, however, is that during assembly of the indoor unit and during maintenance of the indoor unit, the increased length of the communication cable causes the communication adapter to become loose, which reduces the ease of assembly.

The present disclosure aims to address the above-mentioned problem. It is therefore an object of the present disclosure to provide an indoor unit used in an air-conditioning apparatus and including a built-in communication adapter, the indoor unit allowing for improved ease of assembly.

Solution to Problem

According to an embodiment of the present disclosure, there is provided an indoor unit of an air-conditioning apparatus, the indoor unit including a rear housing in which a heat exchanger and an electrical component box are disposed; a front housing disposed in front of the heat exchanger, the front housing being mounted to the rear housing such that the front housing is removable from the rear housing; a front design panel disposed in front of the front housing, the front design panel being mounted to the front housing such that the front design panel is removable from the front housing; a securing and storage part disposed in the front housing and into which a communication adapter is secured, the communication adapter being used for communication with an external device, the securing and storage part being exposed when the front design panel is removed; and a temporary placement part on which to temporarily place the communication adapter.

Advantageous Effects of Invention

An indoor unit of an air-conditioning apparatus according to an embodiment of the present disclosure is designed such that, during assembly and maintenance of the indoor unit, the communication adapter removed from the securing and storage part can be temporarily placed on the temporary placement part. This ensures that, even when the communication cable is designed with enough length to allow a user and a service person to, after removing the communication adapter from the securing and storage part, freely pick up the communication adapter in their hand during operation on the indoor unit, the communication adapter does not become loose during operation because of the length of the communication cable. This helps to improve the ease of operation during assembly and maintenance of the indoor unit.

DESCRIPTION OF EMBODIMENTS

Figure 1:
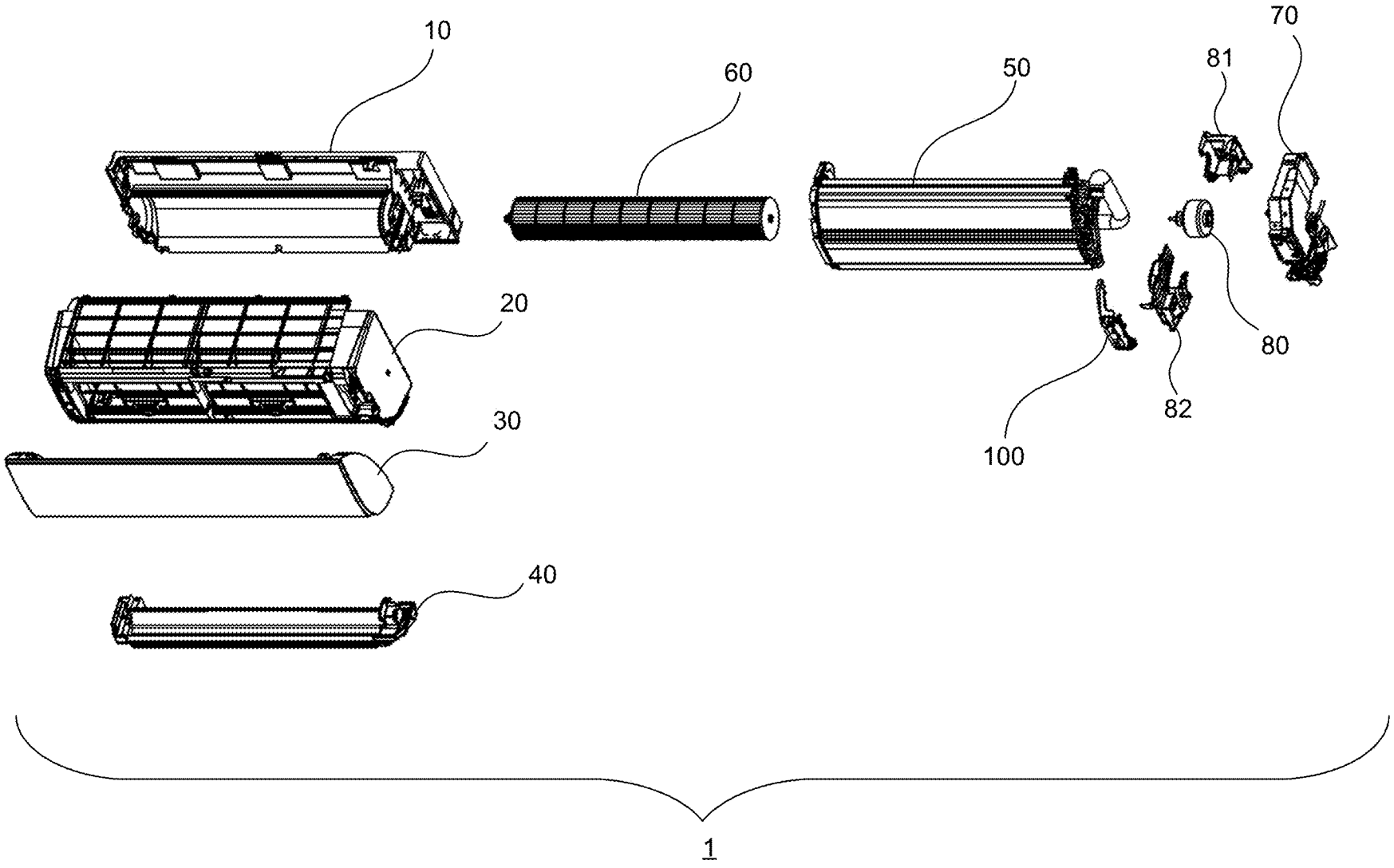
FIG. 1 is an exploded perspective view of an indoor unit of an air-conditioning apparatus according to an embodiment of the present disclosure.

An indoor unit of an air-conditioning apparatus according to an embodiment of the present disclosure is described in detail below with reference to the drawings. The embodiment described below is not intended to be limiting of the present disclosure. In the drawings below, the sizes and shapes of various components may differ from those of the actual apparatus.

Embodiment

<Indoor Unit>

Figure 2:
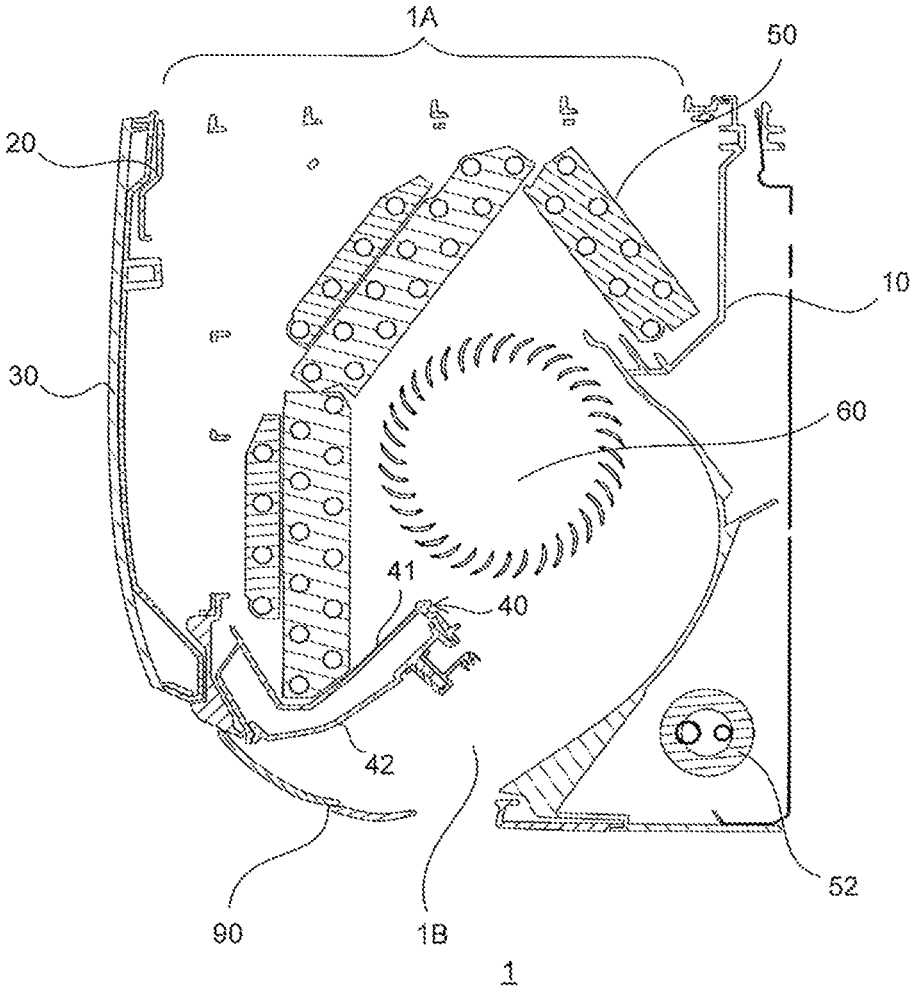
FIG. 2 is a cross-sectional view of the indoor unit of an air-conditioning apparatus according to the embodiment of the present disclosure.

FIG. 1 is an exploded perspective view of an indoor unit 1 of an air-conditioning apparatus according to an embodiment of the present disclosure. FIG. 2 is a cross-sectional view of the indoor unit 1 of an air-conditioning apparatus according to the embodiment of the present disclosure. In FIG. 2, the left-hand side represents the front of the indoor unit 1, and the right-hand side represents the rear of the indoor unit 1. The indoor unit 1 is, for example, a wall-mounted indoor unit that is installed on the wall of an air-conditioned space. The indoor unit 1 includes a rear housing 10, a front housing 20, a front design panel 30, an air outlet structure 40, a heat exchanger 50, a fan 60, and an electrical component box 70. The indoor unit 1 also includes a fan motor 80, a lower holder 81, an upper holder 82, an up-down air deflector 90, a connecting pipe 52, and a dew-flying prevention component 100. The rear housing 10 is a component defining the rear face of the indoor unit 1. The front housing 20 is a component defining the front face of the indoor unit 1. The front housing 20 is disposed in front of the heat exchanger 50, and mounted to the rear housing 10 such that the front housing 20 is removable from the rear housing 10. The rear housing 10 and the front housing 20 define the exterior of the indoor unit 1. The front design panel 30 is disposed in front of the front housing 20 in a manner that allows the front design panel 30 to freely open and close and remove from the front housing 20.

The indoor unit 1 has an air inlet 1A in an upper portion. The air inlet 1A is an opening for directing air from the outside of the indoor unit 1 into the indoor unit 1. The indoor unit 1 has an air outlet 1B in a lower portion. The air outlet 1B is an opening for directing air inside the indoor unit 1 to the outside of the indoor unit 1.

The heat exchanger 50 is used as a condenser during heating operation, and is used as an evaporator during cooling operation. The fan 60 is used to produce a flow of air that is suctioned through the air inlet 1A and passed through the heat exchanger 50 before being blown out through the air outlet 1B.

The electrical component box 70 is a component in which various electrical components necessary for operation of the indoor unit 1 are stored. A control board (not illustrated) is mounted inside the electrical component box 70. The air outlet structure 40 includes a drain pan 41, and an air-passage defining component 42. The drain pan 41 is a component to receive drain water generated during operation of the indoor unit 1. As illustrated in FIG. 2, the drain pan 41 is disposed below the heat exchanger 50. The air-passage defining component 42 allows air that has passed through the heat exchanger 50 to be directed toward the air outlet 1B.

The up-down air deflector 90 is disposed in a lower portion of the front of the indoor unit 1. The up-down air deflector 90 is a component capable of rotational motion and used to adjust the up-down direction of the air to be blown out through the air outlet 1B. The connecting pipe 52 is disposed in a lower portion of the rear of the indoor unit 1. The connecting pipe 52 is a hollow pipe that connects the indoor unit 1 with an outdoor unit (not illustrated).

<Securing and Storage Part and Dew-Flying Prevention Component>

Figure 3:
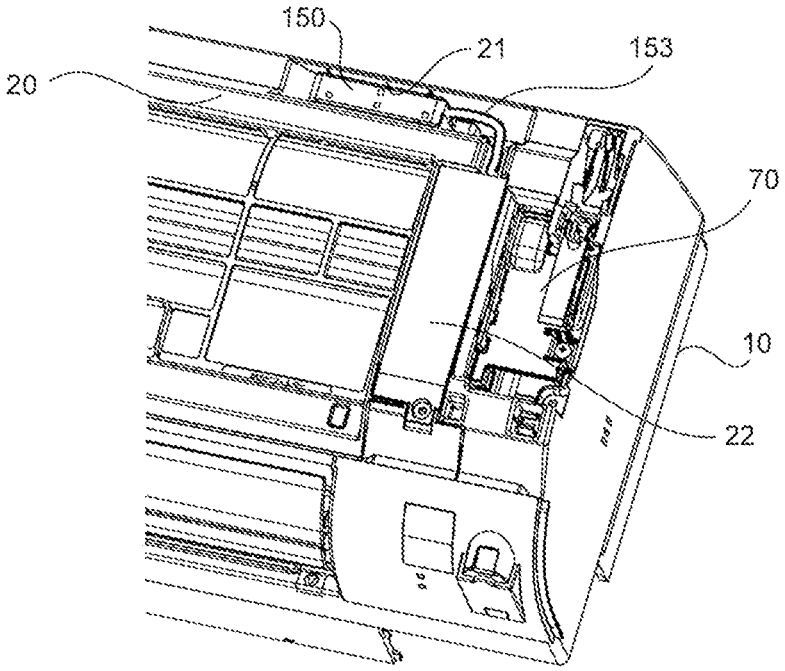
FIG. 3 is a perspective view of a right end portion of the indoor unit of an air-conditioning apparatus according to the embodiment of the present disclosure.

FIG. 3 is a perspective view of a right end portion of the indoor unit 1 of an air-conditioning apparatus according to the embodiment of the present disclosure. FIG. 3 illustrates the indoor unit 1 with the front design panel 30 removed to expose the front housing 20 and the electrical component box 70. A securing and storage part 21 for a communication adapter is disposed in an upper part of a right end portion of the front housing 20, that is, an end portion of the front housing 20 near the electrical component box 70. A communication adapter 150 for communication with an external device is stored in the securing and storage part 21. A communication cable 153 extends from the communication adapter 150. A cover 22 is attached to a portion of the front housing 20 located near the electrical component box 70, The cover 22 is disposed to cover an opening described later that is provided in the front housing 20. At the time of shipping of the indoor unit 1, the communication adapter 150 is secured in the securing and storage part 21. The indoor unit 1 is operated with the communication adapter 150 secured in the securing and storage part 21. By removing the communication adapter 150 from the securing and storage part 21 with the cover 22 attached, the user can freely see the base faces and lateral faces of the communication adapter 150 described later. How the user removes the communication adapter 150 from the securing and storage part 21 will be described later.

Figure 4:
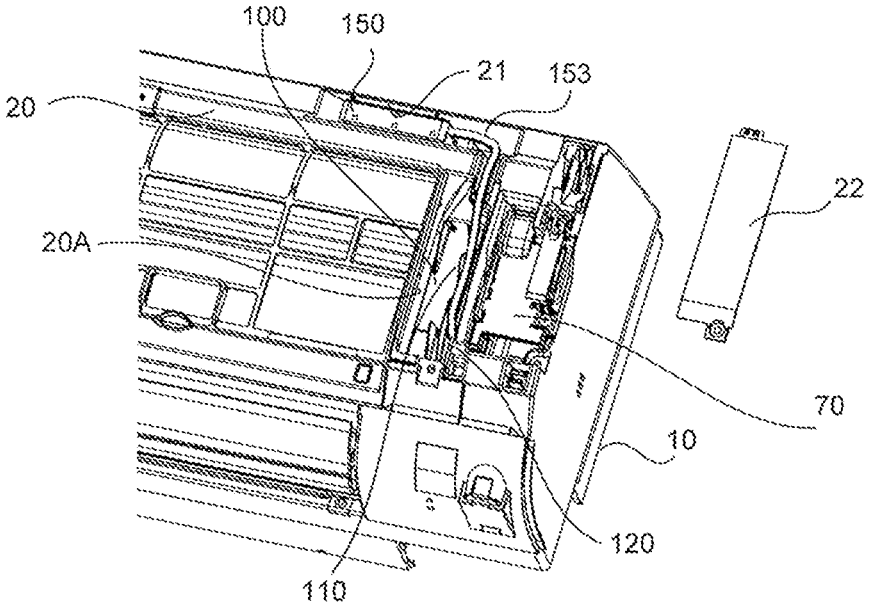
FIG. 4 is a perspective view of a right end portion of the indoor unit of an air-conditioning apparatus according to the embodiment of the present disclosure.

FIG. 4 is a perspective view of a right end portion of the indoor unit 1 of an air-conditioning apparatus according to the embodiment of the present disclosure. FIG. 4 illustrates a state in which the front design panel 30 and the cover 22 have been removed. The dew-flying prevention component 100 is disposed in a right end portion of the front housing 20 and to the left of the electrical component box 70. That is, the dew-flying prevention component 100 is disposed between an end portion of the heat exchanger 50 near the electrical component box 70, and the electrical component box 70. A temporary placement part 110 for the communication adapter 150, and a cable securing part 120 are disposed on the front of the dew-flying prevention component 100. The communication cable 153 extending from the communication adapter 150 is secured to the cable securing part 120 such that the communication cable 153 is removable from the cable securing part 120. The front housing 20 mounted to the rear housing 10 has an opening 20A located in a portion of the front housing 20 that faces the dew-flying prevention component 100. The cover 22 is disposed to cover the opening 20A. Detailed structures of the temporary placement part 110 and the cable securing part 120 will be described later.

The communication cable 153 has such a length that, with the communication adapter 150 secured in the securing and storage part 21, the communication cable 153 does not become slack in a routing path along which the communication cable 153 is routed via the cable securing part 120 between the communication adapter 150 and the electrical component box 70. Further, the length of the communication cable 153 is set such that, when a service person removes the communication adapter 150 from the securing and storage part 21, and removes the communication cable 153 from the cable securing part 120, the communication cable 153 does not interfere with the operation of changing the angle and orientation of the communication adapter 150, which the service person has picked up in their hand. That is, with the communication adapter 150 removed from the securing and storage part 21, and the communication cable 153 removed from the cable securing part 120, the service person is allowed to freely see the base faces and lateral faces of the communication adapter 150 described later.

Figure 5:
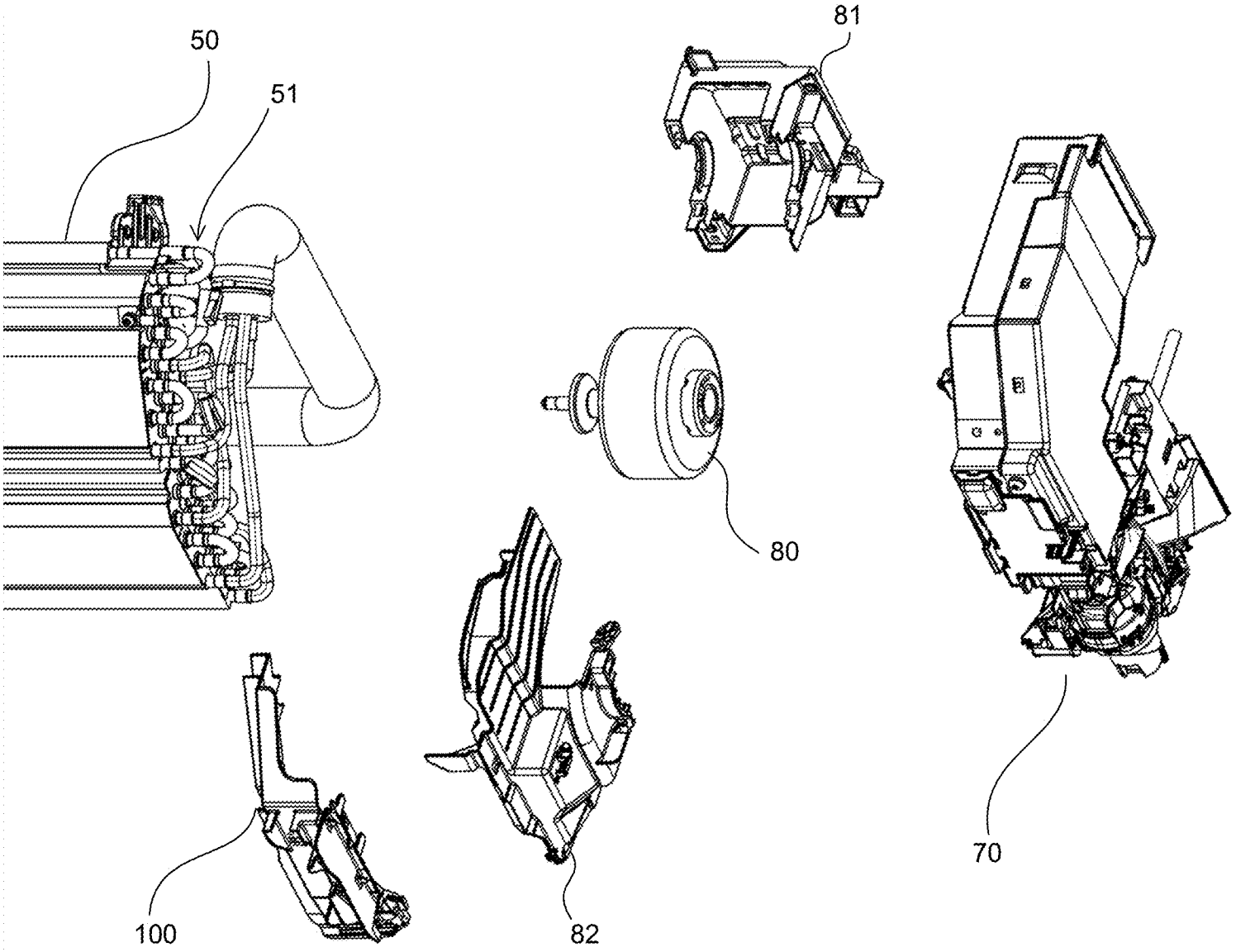
FIG. 5 is an enlarged exploded perspective view of a right end portion of a heat exchanger according to the embodiment of the present disclosure and illustrates the structure of the right end portion.

FIG. 5 is an enlarged exploded perspective view of a right end portion of the heat exchanger 50 according to the embodiment of the present disclosure and illustrates the structure of the right end portion. The fan motor 80 is used to drive the fan 60 illustrated in FIGS. 1 and 2 such that the fan 60 rotates. The fan motor 80 is held in between the lower holder 81 and the upper holder 82. The lower holder 81 is a component to hold a lower portion of the fan motor 80, and the upper holder 82 is a component to hold an upper portion of the fan motor 80.

<Dew-Flying Prevention Component>

The dew-flying prevention component 100 is a component to prevent water droplets generated on a U-bent portion of a heat transfer tube 51 of the heat exchanger 50 from flying toward the front of the indoor unit 1. In this regard, the presence of the upper holder 82 is used to prevent water droplets generated on the U-bent portion of the heat transfer tube 51 from flying toward the electrical component box 70.

<Communication Adapter>

Figure 6:
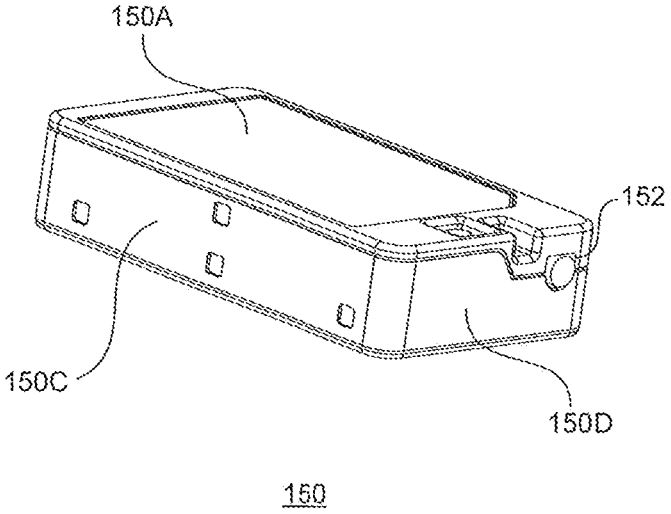
FIG. 6 is a perspective view of a communication adapter according to the embodiment of the present disclosure.
Figure 7:
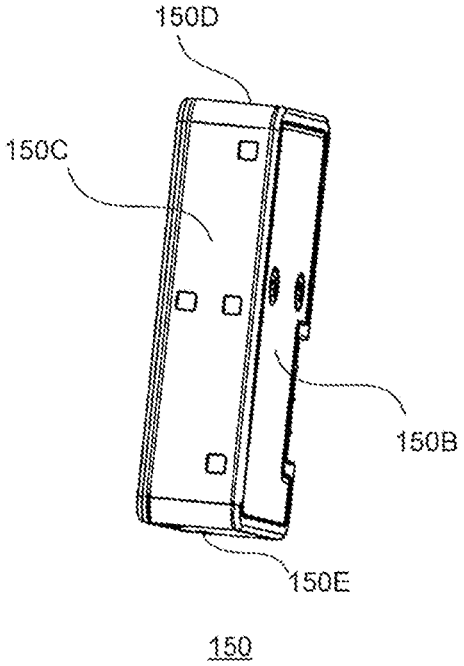
FIG. 7 is a perspective view of the communication adapter according to the embodiment of the present disclosure.

FIGS. 6 and 7 are perspective views of the communication adapter 150 according to the embodiment of the present disclosure. The communication adapter 150 has a cuboid shape as a whole. The communication adapter 150 is made of, for example, a thin translucent material with a white or other color, such as acrylonitrile-butadiene-styrene (ABS) resin. The communication adapter 150 has a pair of rectangular base faces 150A and 150B. Various pieces of information necessary for setting up communications or other purposes are printed on the base faces 150A and 150B. The lateral faces of the communication adapter 150 include a pair of lateral faces extending in the lengthwise direction of the base faces 150A and 150B, and a pair of lateral faces extending in the transverse direction of the base faces 150A and 150B. FIGS. 6 and 7 illustrate a lateral face 1500, which is one of the pair of lateral faces extending in the lengthwise direction. FIG. 6 illustrates a lateral face 150D, which is one of the pair of lateral faces extending in the transverse direction. FIGS. 6 and 7 illustrate the lateral face 150D, and a lateral face 150E, which is the other one of the pair of lateral faces extending in the transverse direction.

The lateral face 150D of the communication adapter 150 has a cable outlet 152. The communication cable 153 illustrated in FIGS. 3 and 4 is led out from the interior of the communication adapter 150 through the cable outlet 152. The cable outlet 152 is located at a position shifted from the center in the transverse direction of the base faces 150A and 150E toward the lateral face opposite to the lateral face 1500.

In the following description, the longitudinal direction of the communication adapter 150 refers to the lengthwise direction of the base faces 150A and 150B, and the lateral direction of the communication adapter 150 refers to a direction perpendicular to the base faces 150A and 150B, and coincides with the direction of thickness of the communication adapter 150. Longitudinally placing the communication adapter 150 means placing the communication adapter 150 such that the longitudinal direction of the communication adapter 150 is aligned with the top-bottom direction of the indoor unit 1, and that the base faces 150A and 150B are aligned with the front-back direction of the indoor unit 1. Laterally placing the communication adapter 150 means placing the communication adapter 150 such that the longitudinal direction of the communication adapter 150 is aligned with the lateral direction of the indoor unit 1, and that the base faces 150A and 150E are aligned with in the front-back direction of the indoor unit 1.

<Dew-Flying Prevention Component>

Figure 8:
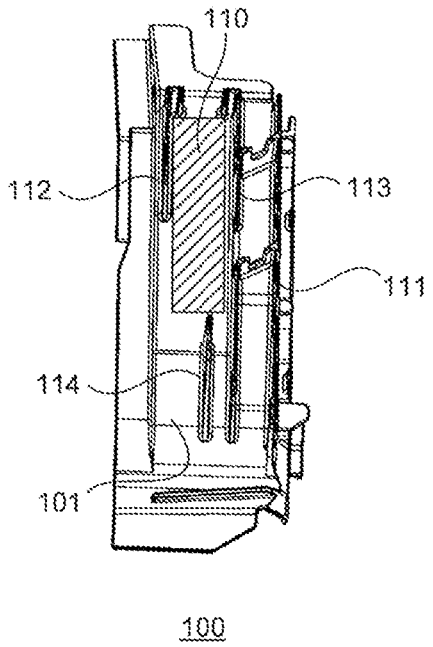
FIG. 8 is a front view of a dew-flying prevention component according to the embodiment of the present disclosure.
Figure 9:
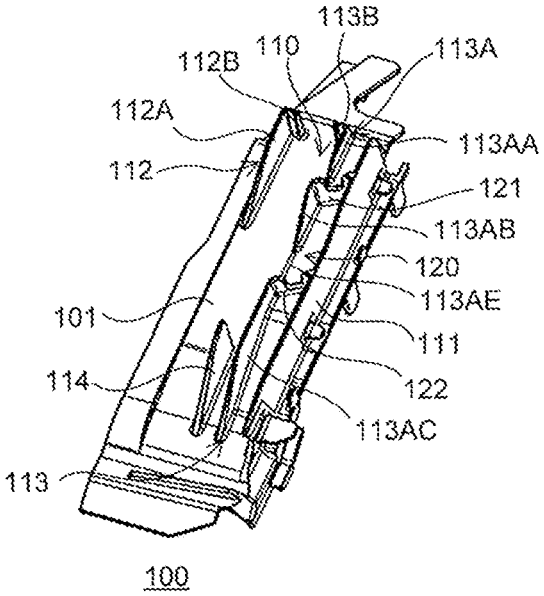
FIG. 9 is a perspective view, as seen obliquely from above right, of the dew-flying prevention component according to the embodiment of the present disclosure.
Figure 10:
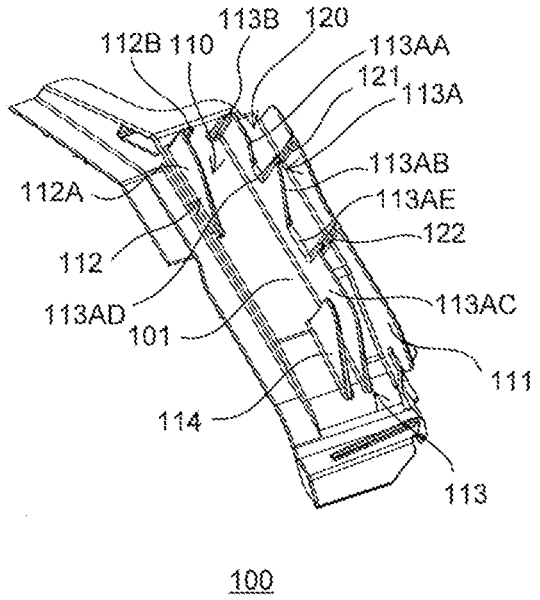
FIG. 10 is a perspective view, as seen obliquely from above left, of the dew-flying prevention component according to the embodiment of the present disclosure.

FIG. 8 is a front view of the dew-flying prevention component 100 according to the embodiment of the present disclosure. FIG. 9 is a perspective view, as seen obliquely from above right, of the dew-flying prevention component 100 according to the embodiment of the present disclosure. FIG. 10 is a perspective view, as seen obliquely from above left, of the dew-flying prevention component 100 according to the embodiment of the present disclosure. FIG. 9 illustrates the dew-flying prevention component 100 as seen from the electrical component box 70 illustrated in FIGS. 1 and 2, and FIG. 10 illustrates the dew-flying prevention component 100 as seen from the heat exchanger 50 illustrated in FIGS. 1 and 2.

The dew-flying prevention component 100 has a face 101 facing toward the front of the indoor unit 1. The face 101 has a side wall part 111, a first rib 112, a second rib 113, and a third rib 114. The side wall part 111, the first rib 112, the second rib 113, and the third rib 114 are disposed orthogonal to the face 101 of the dew-flying prevention component 100. The side wall part 111, the first rib 112, the second rib 113, and the third rib 114 are in the form of a thin plate, and extend in a direction parallel to the top-bottom direction of the indoor unit 1. The side wall part 111 is disposed in a right end portion of the dew-flying prevention component 100, that is, in an end portion of the dew-flying prevention component 100 near the electrical component box 70. The first rib 112 is disposed in a left end portion of the dew-flying prevention component 100, that is, in an end portion of the dew-flying prevention component 100 near the heat exchanger 50. The second rib 113 and the third rib 114 are disposed between the side wall part 111 and the first rib 112.

The first rib 112, the second rib 113, and the third rib 114 define the temporary placement part 110. The second rib 113 and the side wall part 111 define the cable securing part 120. That is, the temporary placement part 110 is located near the heat exchanger 50, and the cable securing part 120 is located near the electrical component box 70. The temporary placement part 110 is a part on which to temporarily place the communication adapter 150. Temporary placement of the communication adapter 150 means to, in mounting and removing the front housing 20 to and from the rear housing 10 in the assembly process and during maintenance of the indoor unit 1, temporarily place the communication adapter 150 in a location different from the securing and storage part 21 where the communication adapter 150 is secured and stored during normal operation. The cable securing part 120 is a part to which the communication cable 153 is secured.

Alternatively, the temporary placement part 110 may be disposed near the electrical component box 70, and the cable securing part 120 may be disposed near the heat exchanger 50, depending on the position of each part relative to nearby components in the interior of the indoor unit 1, and on the internal design of the indoor unit 1.

The first rib 112 has a laterally supporting part 112A, and a longitudinally supporting part 112B. The laterally supporting part 112A extends in the top-bottom direction of the temporary placement part 110. The laterally supporting part 112A has the shape of a substantially right triangle in side view. The laterally supporting part 112A is disposed such that its length in a direction perpendicular to the face 101 decreases gradually from an upper portion toward a lower portion. The longitudinally supporting part 112B is contiguous to an upper end portion of the laterally supporting part 112A. The longitudinally supporting part 112B extends toward the cable securing part 120 in a direction parallel to the lateral direction of the temporary placement part 110. That is, the laterally supporting part 112A and the longitudinally supporting part 112B are orthogonal to each other, and the laterally supporting part 112A and the longitudinally supporting part 112B define a corner. The longitudinally supporting part 112B has, from its end portion contiguous to the laterally supporting part 112A to the free end, the same length as an upper end portion of the laterally supporting part 112A in the direction perpendicular to the face 101.

The laterally supporting part 112A and longitudinally supporting part 112B of the first rib 112 are not limited to the specific forms described above. The shape of each of these parts and its length in the direction perpendicular to the face 101 may be determined depending on the position of the part relative to nearby components in the interior of the indoor unit 1 and on the internal design of the indoor unit 1. The laterally supporting part 112A and the longitudinally supporting part 112B may be disposed such that a gap is present between an upper end portion of the laterally supporting part 112A and a left end portion of the longitudinally supporting part 112B.

The second rib 113 has a laterally supporting part 113A, and a longitudinally supporting part 113B. The laterally supporting part 113A extends in the longitudinal direction, that is, in the top-bottom direction of the temporary placement part 110. The laterally supporting part 113A has a first ridge part 113AA, a second ridge part 113AB, a third ridge part 113AC, a first valley part 113AD, and a second valley part 113AE.

The first ridge part 113AA is located uppermost, and has a substantially trapezoidal shape in side view. The first ridge part 113AA has a length in the direction perpendicular to the face 101 that gradually decreases from an upper portion toward a lower portion. The first valley part 113AD is contiguous to a lower end portion of the first ridge part 113AA. The first valley part 113AD has the same length in the direction perpendicular to the face 101 as the lower end portion of the first ridge part 113AA. The second ridge part 113AB is contiguous to a lower end portion of the first valley part 113AD. The second ridge part 113AB has the shape of a substantially right triangle in side view. An upper end portion of the second ridge part 113AB, that is, an end portion of the second ridge part 113AB contiguous to the first valley part 113AD has a greater length in the direction perpendicular to the face 101 than does an upper end portion of the first ridge part 113AA. The second ridge part 113AB has a length in the direction perpendicular to the face 101 that gradually decreases from an upper portion toward a lower portion. The second valley part 113AE is contiguous to a lower end portion of the second ridge part 113AB. The second valley part 113AE has the same length in the direction perpendicular to the face 101 as a lower end portion of the second ridge part 113AB. The third ridge part 113AC is contiguous to a lower end portion of the second valley part 113AE. The third ridge part 113AC has a substantially trapezoidal shape in side view. The third ridge part MAC has a length in the direction perpendicular to the face 101 that gradually decreases from an upper portion toward a lower portion.

The longitudinally supporting part 113E is contiguous to an upper end portion of the first ridge part 113AA of the laterally supporting part 113A. The longitudinally supporting part 113B extends in a direction parallel to the lateral direction of the temporary placement part 110 and away from the cable securing part 120. The first ridge part 113AA of the laterally supporting part 113A, and the longitudinally supporting part 113E are orthogonal to each other, and the first ridge part 113AA and the longitudinally supporting part 113B define a corner.

Further, the free end of the longitudinally supporting part 112G of the first rib 112, and the free end of the longitudinally supporting part 113G of the second rib 113 face each other with a space between the free ends.

The corner defined by the laterally supporting part 112A and the longitudinally supporting part 1123, and the corner defined by the first ridge part 113AA of the laterally supporting part 113A and the longitudinally supporting part 113G are located at substantially the same position in the top-bottom direction of the temporary placement part 110. In other words, the lower face of the longitudinally supporting part 112B, and the lower face of the longitudinally supporting part 1133 are located at substantially the same position in the top-bottom direction of the temporary placement part 110.

The first ridge part 113AA, the second ridge part 113AB, the third ridge part 113AC, the first valley part 113AD, and the second valley part 113AE of the laterally supporting part 113A of the second rib 113, and the longitudinally supporting part 113B of the second rib 113 are not limited to the specific forms described above. The shape of each of these parts, and its length in the direction perpendicular to the face 101 may be determined depending on the position of the part relative to nearby components in the interior of the indoor unit 1 and on the internal design of the indoor unit 1. The laterally supporting part 113A and the longitudinally supporting part 113B may be disposed such that a gap is present between an upper end portion of the first ridge part 113AA and a right end portion of the longitudinally supporting part 113B.

The third rib 114 has a substantially right triangle in side view. The third rib 114 has a length in the direction perpendicular to the face 101 that gradually decreases from an upper portion toward a lower portion. In the top-bottom direction of the temporary placement part 110, the third rib 114 is positioned in substantially the same location as the lower half of the third ridge part 113AC of the laterally supporting part 113A of the second rib 113. The third rib 114 and the third ridge part 113AC extend in parallel to each other with a space between the third rib 114 and the third ridge part 113AC.

The third rib 114 is not limited to the specific form described above. The shape of the third rib 114, and the length of the third rib 114 in the direction perpendicular to the face 101 may be determined depending on the position of the third rib 114 relative to nearby components in the interior of the indoor unit 1 and on the internal design of the indoor unit 1.

The length in the lateral direction between the first rib 112 and the second rib 113 is slightly less than the length in the direction of thickness of the communication adapter 150, The length in a direction parallel to the top-bottom direction between an upper end portion of the third rib 114, and the lower face of the longitudinally supporting part 112B of the first rib 112 and the lower face of the longitudinally supporting part 113B of the second rib 113 is slightly less than the length in the longitudinal direction of the communication adapter 150.

A first cable-support plate 121 and a second cable-support plate 122 are disposed between the side wall part 111 and the second rib 113, that is, in the cable securing part 120. The first cable-support plate 121 is in the form of a thin plate, and has a U-shaped cutout in an upper end portion. One end portion of the first cable-support plate 121 is located at the boundary between the first valley part 113AD and the second ridge part 113AB of the second rib 113, The other end portion of the first cable-support plate 121 is positioned higher than the one end portion of the first cable-support plate 121. That is, the first cable-support plate 121 slopes downward from the side wall part 111 toward the second rib 113.

Likewise, the second cable-support plate 122 is in the form of a thin plate, and has a U-shaped cutout in an upper end portion. One end portion of the second cable-support plate 122 is located at the boundary between the second valley part 113AE and the third ridge part 113AC of the second rib 113. The other end portion of the second cable-support plate 122 is positioned higher than the one end portion of the second cable-support plate 122. That is, the second cable-support plate 122 slopes downward from the side wall part 111 toward the second rib 113.

The communication adapter 150 is temporarily placed on a region with diagonal lines in FIG. 8, that is, the temporary placement part 110. There are two orientations in which the communication adapter 150 is temporarily placed on the temporary placement part 110. In its first orientation, the communication adapter 150 is disposed such that the base face 150A is in contact with the laterally supporting part 112A, the base face 150B is in contact with the laterally supporting part 113A, and opposite end portions of the lateral face 1500 are in contact with the longitudinally supporting part 112B and with the longitudinally supporting part 113B. That is, opposite end portions of the edge extending in the transverse direction of the lateral face 150D are in contact with the corner defined by the laterally supporting part 112A and the longitudinally supporting part 1123, and with the corner defined by the first ridge part 113AA of the laterally supporting part 113A and the longitudinally supporting part 1133. With the communication adapter 150 temporarily placed in its first orientation, the lateral face 150E is in contact with the upper end of the third rib 114, the lateral face opposite to the lateral face 1500 is in contact with the face 101, and the lateral face 1500 is exposed toward the front of the indoor unit 1. In this state, a portion of the base face 150A is exposed from below the first rib 112, and a portion of the base face 150B is exposed from the first valley part 113AD and from the second valley part 113AE.

In its second orientation, the communication adapter 150 is disposed such that the base face 150A is in contact with the laterally supporting part 113A, the base face 150E is in contact with the laterally supporting part 112A, and opposite end portions of the lateral face 150D are in contact with the longitudinally supporting part 112B and with the longitudinally supporting part 113B. That is, opposite end portions of the edge extending in the transverse direction of the lateral face 150D are in contact with the corner defined by the laterally supporting part 112A and the longitudinally supporting part 112B, and with the corner defined by the first ridge part 113AA of the laterally supporting part 113A and the longitudinally supporting part 113B. With the communication adapter 150 temporarily placed in its second orientation, the lateral face 150E is in contact with the upper end of the third rib 114, the lateral face opposite to the lateral face 1500 is exposed toward the front of the indoor unit 1, and the lateral face 1500 is in contact with the face 101. In this state, a portion of the base face 150E is exposed from below the first rib 112, and a portion of the base face 150A is exposed from the first valley part 113AD and from the second valley part 113AE.

In both its first orientation and its second orientation, the communication adapter 150 is placed longitudinally on the temporary placement part 110. As described above, the length in the lateral direction between the first rib 112 and the second rib 113 is slightly less than the length in the direction of thickness of the communication adapter 150. This ensures that the communication adapter 150 is sandwiched between the laterally supporting part 112A and the laterally supporting part 113A, and thus the temporary placement location of the communication adapter 150 is not displaced in the lateral direction.

The length in a direction parallel to the top-bottom direction between an upper end portion of the third rib 114, and the lower face of the longitudinally supporting part 112B of the first rib 112 and the lower face of the longitudinally supporting part 113B of the second rib 113 is slightly less than the length in the longitudinal direction of the communication adapter 150. This ensures that the communication adapter 150 is sandwiched between the third rib 114 and each of the longitudinally supporting part 112B and the longitudinally supporting part 113B, and thus the temporary placement location of the communication adapter 150 is not displaced in the longitudinal direction.

In both its first orientation and its second orientation, the lateral face 150D having the cable outlet 152 is in contact with the longitudinally supporting part 112B and with the longitudinally supporting part 113B. The communication cable 153 extending from the cable outlet 152 is therefore routed to the outside of the temporary placement part 110 from between the longitudinally supporting part 112B and the longitudinally supporting part 113B.

After the communication cable 153 is routed to the outside of the temporary placement part 110 from between the longitudinally supporting part 112B and the longitudinally supporting part 1133, the communication cable 153 is retained to the U-shaped cutout provided in each of the first cable-support plate 121 and the second cable-support plate 122, and positioned in place as illustrated in FIG. 4.

<Securing and Storage Part>

Figure 11:
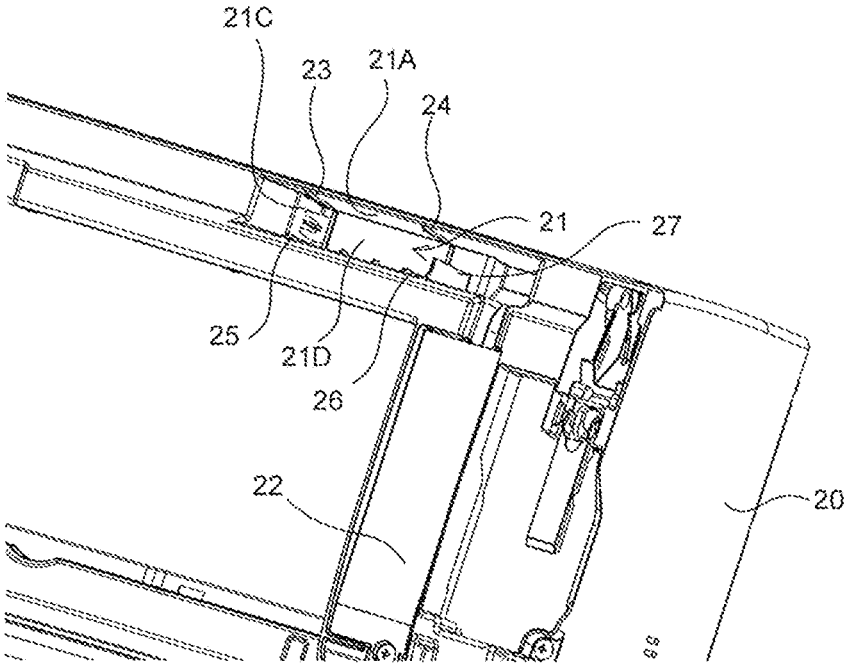
FIG. 11 is a perspective view, as seen obliquely from above right, of a securing and storage part for securing the communication adapter in place according to the embodiment of the present disclosure.
Figure 12:
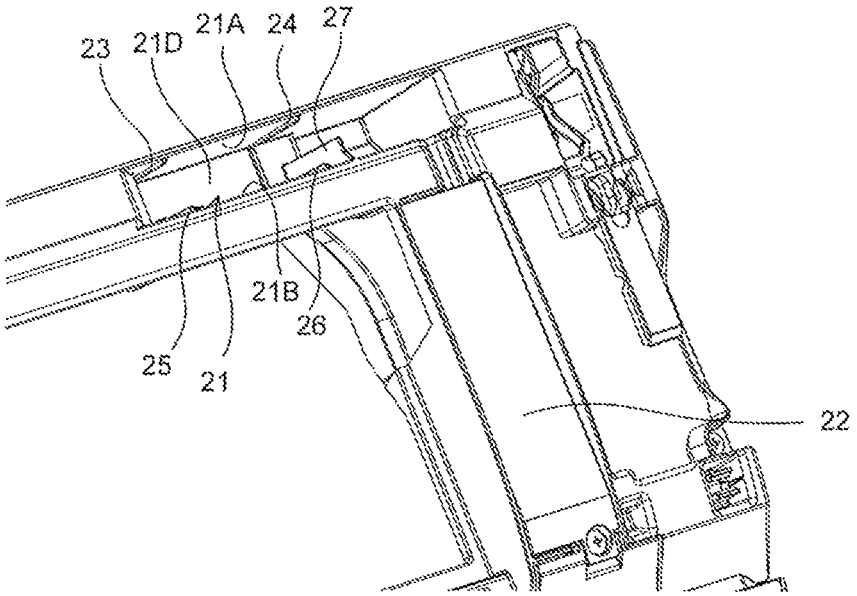
FIG. 12 is a perspective view, as seen obliquely from above left, of the securing and storage part for securing the communication adapter in place according to the embodiment of the present disclosure.

FIG. 11 is a perspective view, as seen obliquely from above right, of the securing and storage part for the communication adapter according to the embodiment of the present disclosure. FIG. 12 is a perspective view, as seen obliquely from above left, of the securing and storage part for the communication adapter according to the embodiment of the present disclosure. The securing and storage part 21 is a box-shaped recess, which is open to the front of the indoor unit 1. The inner wall face of the securing and storage part 21 includes an upper face 21A and a lower face 21B, which are respectively located at the upper and lower faces in the top-bottom direction of the indoor unit 1, and a lateral face 21C, which is located at the left face in the lateral direction. The securing and storage part 21 is open on the right face in the lateral direction. The length between the upper face 21A and the lower face 21B below the upper face 21A, that is, the width is slightly greater than the length of the communication adapter 150 in the thickness direction, that is, the width of the communication adapter 150.

The upper face 21A is provided with two protruding support parts 23 and 24 for the communication adapter 150. The support part 23 and the support part 24 extend from a bottom face 21D toward the open portion of the securing and storage part 21 near the front of the indoor unit 1, that is, in the front-back direction of the indoor unit 1. The lower face 21B is provided with two protruding support parts 25 and 26 for the communication adapter 150. The support part 25 and the support part 26 extend from the bottom face 210 toward the open portion of the securing and storage part 21, that is, in the front-back direction of the indoor unit 1. The support part 23 and the support part 25 are positioned facing each other in the top-bottom direction of the indoor unit 1. The support part 24 and the support part 26 are positioned facing each other in the top-bottom direction of the indoor unit 1.

At the location of the opening near the front of the indoor unit 1, the length between the support part 23 and the support part 25, and the length between the support part 24 and the support part 26 are each slightly less than the length in the direction of thickness of the communication adapter 150. The amount that the support part 23 and the support part 24 protrude from the upper face 21A is smallest at the location of the opening near the front of the indoor unit 1, and gradually increases toward the bottom face 210. The amount that the support part 25 and the support part 26 protrude from the lower face 21B is smallest at the location of the opening near the front of the indoor unit 1, and gradually increases toward the bottom face 21D.

The lower face 21B is provided with a positioning support plate 27 located to the right of the support part 26. The positioning support plate 27 is provided to determine the orientation in which the communication adapter 150 is stored into the securing and storage part 21. The positioning support plate 27 is in the form of a thin rectangular plate. The positioning support plate 27 is disposed with its lengthwise direction aligned with the front-back direction of the indoor unit 1, and with its transverse direction aligned with the top-bottom direction of the indoor unit 1. The length between the lateral face 21C and the positioning support plate 27, that is, the width is slightly greater than the length in the longitudinal direction of the communication adapter 150.

The positioning support plate 27 has a length in the transverse direction that is, for example, substantially half the length between the upper face 21A and the lower face 21B. That is, the positioning support plate 27 has a length in the transverse direction that is substantially half the length in the direction of thickness of the communication adapter 150. Accordingly, the upper face 21A and the positioning support plate 27 are spaced apart from each other by a length equal to substantially half the length in the direction of thickness of the communication adapter 150.

The communication adapter 150 is stored in the securing and storage part 21 such that the base face 150A illustrated in FIGS. 6 and 7 faces the upper face 21A, the base face 150B illustrated in FIG. 7 faces the lower face 21B, and the lateral face 150D illustrated in FIGS. 6 and 7 faces the positioning support plate 27. That is, the communication adapter 150 is placed laterally in the securing and storage part 21.

The communication cable 153 extending from the cable outlet 152 provided in the lateral face 1500 is guided toward the cable securing part 120 from between the upper face 21A and the positioning support plate 27.

In the foregoing description of the embodiment, in the top-bottom direction of the indoor unit 1, the support part 23 and the support part 25 of the securing and storage part 21 are positioned facing each other, and the support part 24 and the support part 26 of the securing and storage part 21 are positioned facing each other. However; this is not intended to be limiting. It is not necessary to make the number of protruding support parts on the upper face 21A equal to the number of protruding support parts on the lower face 21B, nor is it necessary to align the lateral location of each protruding support part on the upper face 21A with the lateral location of the corresponding protruding support part on the lower face 21B. In one example, the upper face 21A may be provided with the support part 23 and the support part 24 as described above, and the lower face 21B may be provided with one or more support parts positioned to face a location between the support part 23 and the support part 24. In another example, the lower face 21B may be provided with the support part 25 and the support part 26 as described above, and the upper face 21A may be provided with one or more support parts positioned to face a location between the support part 25 and the support part 26.

In the embodiment, the communication cable 153 has a length such that, when the communication adapter 150 is placed laterally in the securing and storage part 21, the communication cable 153 does not become slack between the communication adapter 150 and the electrical component box 70, more specifically, between the cable outlet 152 and the electrical component box 70.

<Communication Cable>

Figure 13:
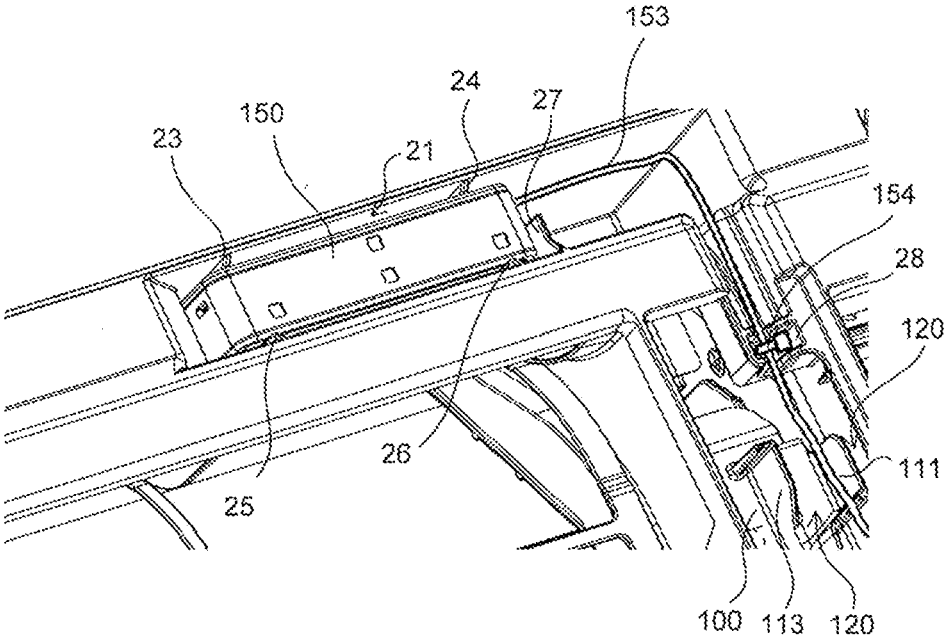
FIG. 13 is an enlarged view of an upper right end portion of a front housing of the indoor unit according to the embodiment.
Figure 14:
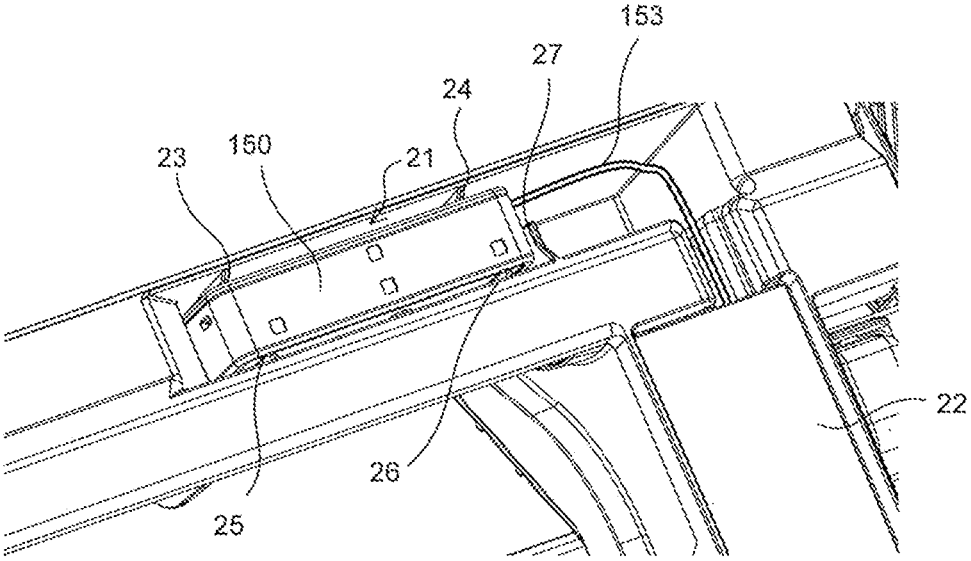
FIG. 14 is an enlarged view of an upper right end portion of the front housing of the indoor unit according to the embodiment.

FIGS. 13 and 14 are enlarged views of an upper right end portion of the front housing 20 of the indoor unit 1 according to the embodiment. FIG. 13 illustrates a state in which the front design panel 30 and the cover 22 are removed. FIG. 14 illustrates a state in which the front design panel 30 is removed, and the cover 22 is attached. As illustrated in FIG. 13, the front housing 20 is provided with a band-position retaining part 28 located above the dew-flying prevention component 100. A binding band 154 is attached to the communication cable 153 of the communication adapter 150. The binding band 154 is attached to a position on the communication cable 153 routed from the communication adapter 150 to the cable securing part 120 of the dew-flying prevention component 100, the position corresponding to the band-position retaining part 28, The communication cable 153 and the binding band 154 are received in the band-position retaining part 28.

Figure 15:
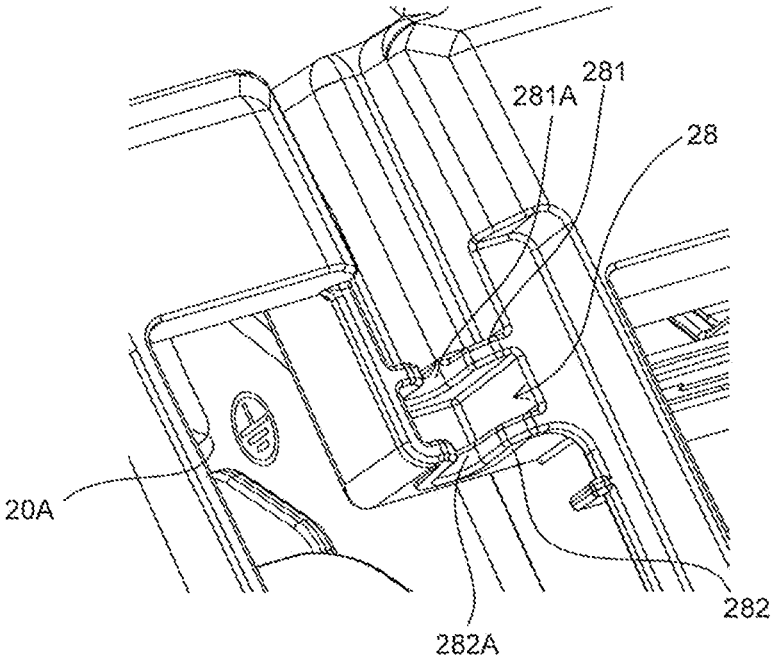
FIG. 15 is an enlarged perspective view of a band-position retaining part according to the embodiment.

FIG. 15 is an enlarged perspective view of the band-position retaining part 28. The band-position retaining part 28 is a box-shaped recess. In the band-position retaining part 28, a pair of wall faces 281 and 282 facing each other in the top-bottom direction of the indoor unit 1 respectively have U-shaped cutouts 281A and 282A.

Inside the band-position retaining part 28, the communication cable 153 is supported on the cutout 281A provided in the wall face 281 and on the cutout 282A provided in the wall face 282. The presence of the wall faces 281 and 282 prevents displacement of the binding band 154 in the top-bottom direction of the indoor unit 1. As illustrated in FIG. 14, the band-position retaining part 28 is covered with the cover 22 when the cover 22 is attached over the band-position retaining part 28.

The length of a portion of the communication cable 153 between the communication adapter 150 and the location of attachment of the binding band 154 is set such that with the opening 20A closed off by the cover 22, the user is allowed to remove the communication adapter 150 from the securing and storage part 21 and pick up the communication adapter 150 in their hand. This helps to ensure that with the opening 20A closed off by the cover 22, the user is allowed to check various information printed on the communication adapter 150, <Cover>

Figure 16:
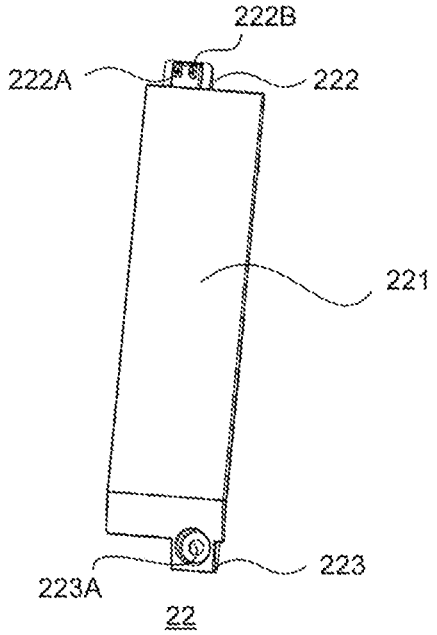
FIG. 16 is a front view of a cover for covering an opening provided in the front housing according to the embodiment of the present disclosure.

FIG. 16 is a front view of the cover 22 for covering the opening 20A provided in the front housing 20. The cover 22 has a body 221, a hook-forming part 222, and a screw fastening part 223. The hook-forming part 222 is disposed near an upper end portion of the body 221, and the screw fastening part 223 is disposed near a lower end portion of the body 221. A hook 222A and a hook 222B are disposed on the back of the hook-forming part 222. The screw fastening part 223 has a screw hole 223A.

Figure 17:
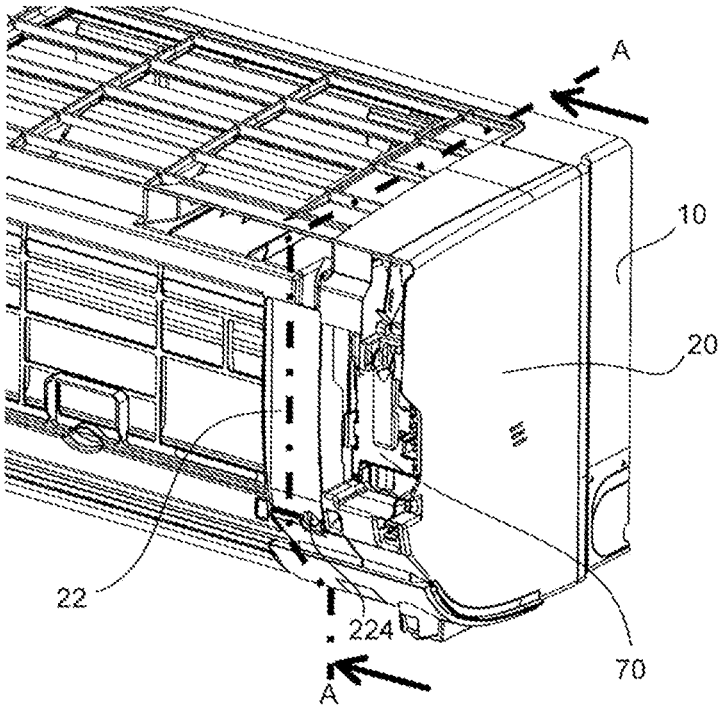
FIG. 17 is an enlarged view of a right end portion of the indoor unit according to the embodiment of the present disclosure.

FIG. 17 is an enlarged view of a right end portion of the indoor unit 1 according to the embodiment of the present disclosure, FIG. 17 illustrates a state in which the front design panel 30 is removed. As described above, the cover 22 is disposed between a right end portion of the front housing 20 and the electrical component box 70 to cover the dew-flying prevention component 100. A lower portion of the cover 22 is secured to the front housing 20 with a screw 224.

By removing the screw 224, and releasing locking engagement of the hook 222A and the hook 222B with the front housing 20, the cover 22 is removable from the front housing 20.

Figure 18:
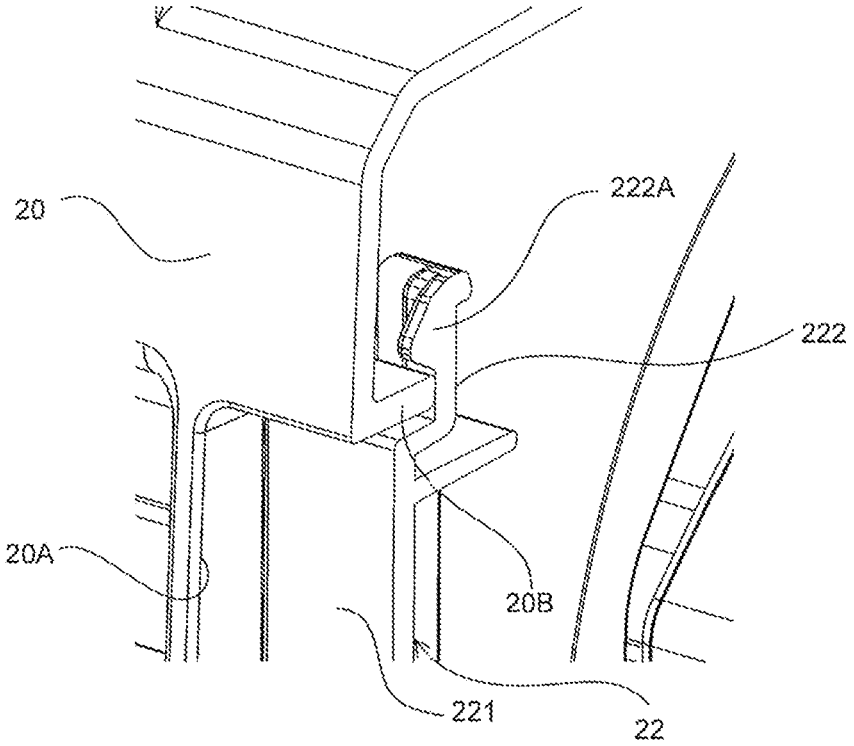
FIG. 18 illustrates an end face of the indoor unit according to the embodiment of the present disclosure taken along the line A-A in FIG. 17 and illustrates a hook-forming part and its vicinity as viewed along the arrows in FIG. 17.

FIG. 18 illustrates an end face of the indoor unit 1 taken along the line A-A in FIG. 17 and illustrates the hook-forming part 222 and its vicinity as viewed along the arrows in FIG. 17. The hook 222A is in locking engagement with a receiving part 20B in an upper edge portion of the opening 20A of the front housing 20, the receiving part 20B being a plate-like part disposed orthogonal to the back of the front housing 20. Likewise, the hook 222B is in locking engagement with the receiving part 20B in the same manner.

As described above, in the embodiment, when the front design panel 30 is removed, the communication adapter 150 secured in the securing and storage part 21 is exposed. Further, with the front design panel 30 removed, the opening 20A is closed off by the cover 22 so that the temporary placement part 110 and the cable securing part 120 are not exposed.

<Assembly Procedure>

Figure 19:
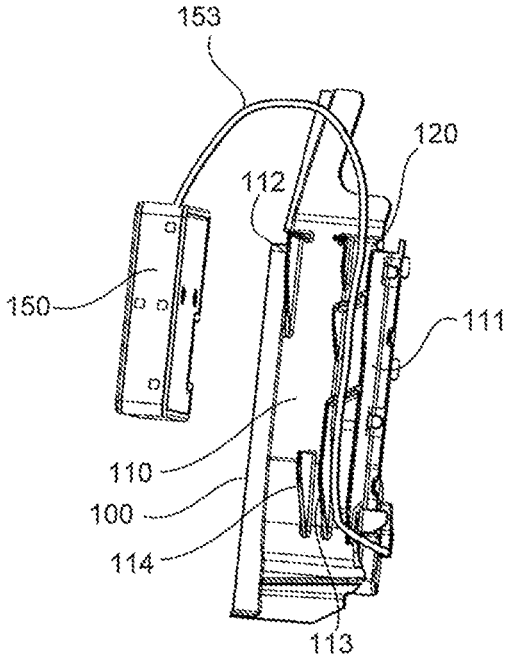
FIG. 19 is a perspective view of the indoor unit according to the embodiment of the present disclosure before temporary placement of the communication adapter.

An assembly procedure for the indoor unit 1 is described below. First, the heat exchanger 50, the fan 60, and the electrical component box 70 are installed onto the rear housing 10 illustrated in FIG. 1. At this timing, the fan motor 80, the lower holder 81, and the upper holder 82 illustrated in FIGS. 1 and 5 are incorporated into the resulting assembly. Then, the dew-flying prevention component 100 illustrated in FIGS. 1 and 5 is installed. The communication cable 153 is then connected to the electrical component box 70. Then, the communication cable 153 is routed to the cable securing part 120. FIG. 19 is a perspective view of the dew-flying prevention component 100 and the communication adapter 150 of the indoor unit 1 according to the embodiment of the present disclosure, before the communication adapter 150 is temporarily placed and after the communication cable 153 is secured to the cable securing part 120.

Figure 20:
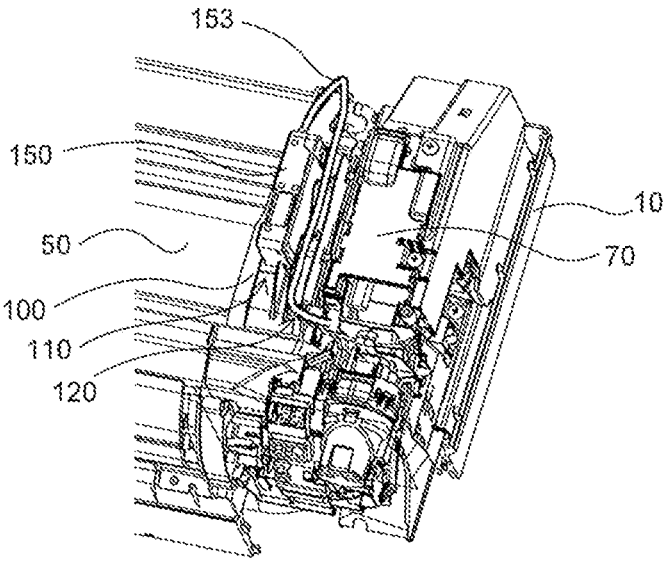
FIG. 20 is a perspective view of the indoor unit according to the embodiment of the present disclosure after temporary placement of the communication adapter.

FIG. 20 is a perspective view of the indoor unit 1 according to the embodiment of the present disclosure after temporary placement of the communication adapter 150. With the communication cable 153 secured to the cable securing part 120 of the dew-flying prevention component 100, the communication adapter 150 is temporarily placed in a longitudinal orientation on the temporary placement part 110 of the dew-flying prevention component 100.

Figure 21:
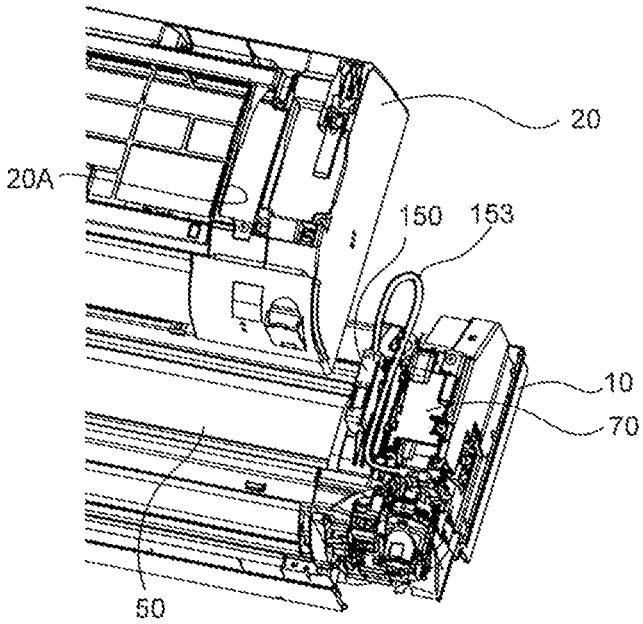
FIG. 21 is a perspective view of the indoor unit according to the embodiment of the present disclosure during mounting of the front housing.
Figure 22:
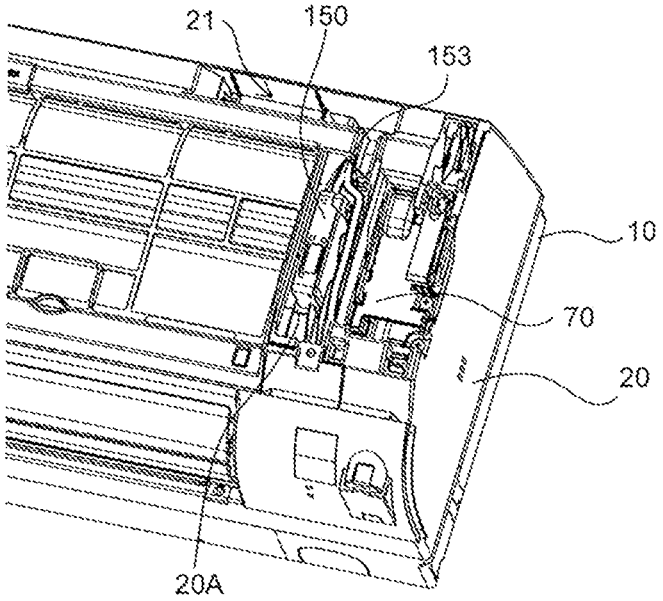
FIG. 22 is a perspective view of the indoor unit according to the embodiment of the present disclosure after mounting of the front housing.
Figure 23:
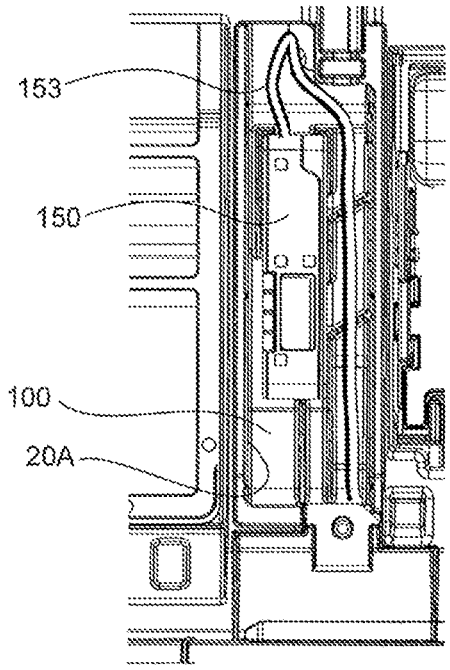
FIG. 23 is a front view of the indoor unit according to the embodiment of the present disclosure after mounting of the front housing.

FIG. 21 is a perspective view of the indoor unit 1 according to the embodiment of the present disclosure during mounting of the front housing 20. FIG. 22 is a perspective view of the indoor unit 1 according to the embodiment of the present disclosure after mounting of the front housing 20. FIG. 23 is a front view of the indoor unit 1 according to the embodiment of the present disclosure after mounting of the front housing 20. As illustrated in FIG. 21, the front housing 20 is positioned in front of the heat exchanger 50, and mounted to the rear housing 10. As illustrated in FIGS. 22 and 23, with the front housing 20 mounted to the rear housing 10, the communication adapter 150, which has been temporarily placed, and the communication cable 153, which has been secured in place, are exposed through the opening 20A of the front housing 20. Subsequently, with the communication cable 153 remaining retained to the cable securing part 120, the communication adapter 150 is removed from the temporary placement part 110. Then, the communication adapter 150 is taken out through the opening 20A, and after the binding band 154 is placed inside the band-position retaining part 28, the communication adapter 150 is secured into the securing and storage part 21.

Figure 24:
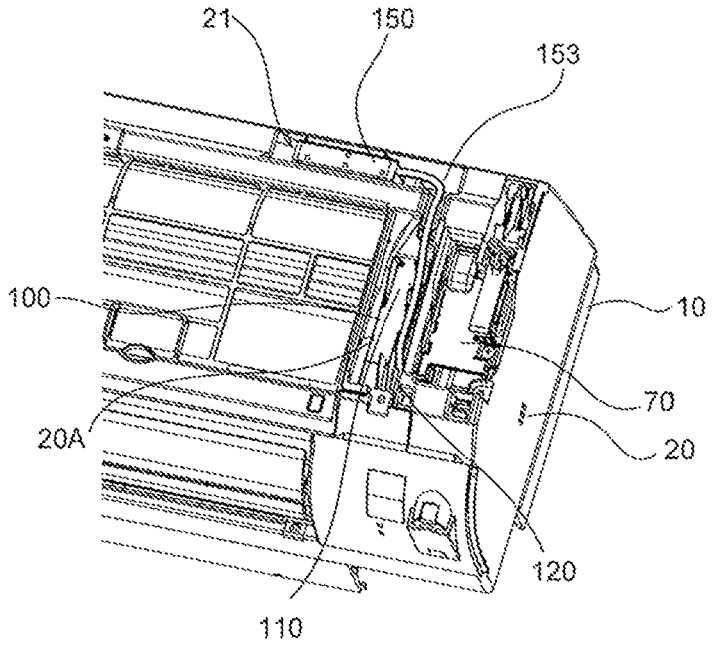
FIG. 24 is a perspective view of the indoor unit according to the embodiment of the present disclosure with the communication adapter secured in the securing and storage part.
Figure 25:
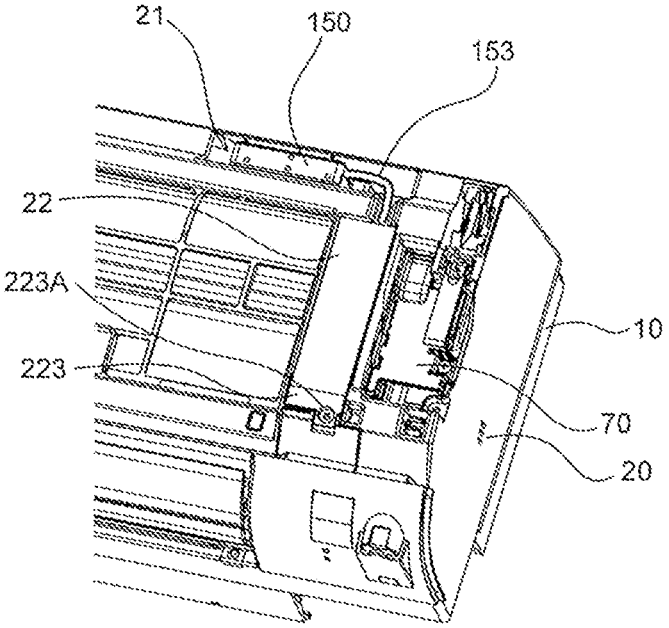
FIG. 25 is a perspective view of the indoor unit according to the embodiment of the present disclosure with the cover attached after the communication adapter is secured into the securing and storage part.

FIG. 24 is a perspective view of the indoor unit 1 according to the embodiment of the present disclosure with the communication adapter 150 secured in the securing and storage part 21. FIG. 25 is a perspective view of the indoor unit 1 according to the embodiment of the present disclosure with the cover 22 attached after the communication adapter 150 is secured in the securing and storage part 21, In the state illustrated in FIG. 24, the communication adapter 150 is secured to the cable securing part 120 of the front housing 20, and the communication cable 153 is retained to the cable securing part 120 of the dew-flying prevention component 100. The front parts of the dew-flying prevention component 100, that is, the temporary placement part 110 and the cable securing part 120 are exposed through the opening 20A. In this state, the cover 22 is attached to the front housing 20 to cover the front of the dew-flying prevention component 100. To attach the cover 22, first, as illustrated in FIG. 18, the hook 222A and the hook 222B are brought into locking engagement with the receiving part 20B of the front housing 20. Then, with the hook 222A and the hook 222B being in locking engagement with the receiving part 20B, the screw 224 is inserted through the screw hole 223A of the screw fastening part 223 and, as illustrated in FIG. 17, a lower portion of the cover 22 is secured to the front housing 20 with the screw 224. Thus, as illustrated in FIG. 25, the front of the dew-flying prevention component 100 is covered by the cover 22. In this state, the front design panel 30 illustrated in FIG. 1 is mounted to the front housing 20 in a manner that allows the front design panel 30 to open and close.

<Maintenance>

In performing maintenance, the indoor unit 1 is disassembled by a procedure reverse to the assembly procedure. That is, the front design panel 30 is removed, which results in the state illustrated in FIG. 25. Then, the cover 22 is removed, which results in the state illustrated in FIG. 24. Subsequently, the communication adapter 150 is removed from the securing and storage part 21 of the front housing 20, the binding band 154 is removed from the band-position retaining part 28, and the communication adapter 150 is temporarily placed on the temporary placement part 110 of the dew-flying prevention component 100. These operations result in the state illustrated in FIGS. 22 and 23. Then, as illustrated in FIG. 21, with the communication adapter 150 remaining temporarily placed on the temporary placement part 110, the front housing 20 is removed from the rear housing 10, which results in the state illustrated in FIG. 20.

According to the embodiment, separately from the securing and storage part 21, the temporary placement part 110 for the communication adapter 150 is provided in the dew-flying prevention component 100. As described above, in mounting and removing the front housing 20 to and from the rear housing 10 during assembly and maintenance of the indoor unit 1, the communication adapter 150 is therefore allowed to be temporarily placed on the temporary placement part 110. As a result, even when the communication adapter 150 is not secured in the securing and storage part 21, the communication adapter 150 does not become loose during operation on the indoor unit 1. This improves the ease of operation during assembly and maintenance of the indoor unit 1.

The presence of the temporary placement part 110 helps to ensure that the front housing 20 can be mounted and removed with the communication adapter 150 temporarily placed on the temporary placement part 110, and with the communication cable 153 remaining connected to the control board in the electrical component box 70. This improves the ease of operation during assembly and maintenance of the indoor unit 1.

As described above, the communication adapter 150 can be temporarily placed on the temporary placement part 110 during operation on the indoor unit 1. The communication cable 153 can therefore be designed with enough length to allow a user and a service person to remove the communication adapter 150 from the securing and storage part 21 and freely pick up the communication adapter 150 in their hand during operation. This results in improved ease of operation during maintenance of the indoor unit 1, As the communication adapter 150 can be secured to the temporary placement part 110, even when the communication cable 153 has an increased length, the communication cable 153 does not interfere with the mounting and removal of the front housing 20.

As described above, the communication adapter 150 does not become loose during operation on the indoor unit 1. This helps to ensure that the communication adapter 150 does not hit the heat exchanger 50 or other nearby components and thus damage the heat exchanger 50 or other components. The reduced contact with the heat exchanger 50 or other nearby components helps to reduce damage to the communication adapter 150 itself. Damage to the print on the outside of the communication adapter 150 can be also reduced. Further, the aesthetic design of the communication adapter 150 is not compromised.

According to the embodiment, the cover 22 is disposed over the opening 20A through which the temporary placement part 110 and the cable securing part 120 are exposed. This prevents entry of foreign matter through the opening 20A, and insertion of a finger or other objects through the opening 20A.

According to the embodiment, an upper portion of the cover 22 is in locking engagement by the hook 222A and the hook 222B with the receiving part 20B of the front housing 20, and a lower portion of the cover 22 is secured by the screw 224 to the front housing 20. Even when the screw 224 comes off, the locking engagement of the hook 222A and the hook 222B with the receiving part 20B therefore prevents the cover 22 from fading off.

According to the embodiment, the securing and storage part 21 is provided with the positioning support plate 27. In storing the communication adapter 150 into the securing and storage part 21, to ensure that the communication cable 153 is guided to the outside of the securing and storage part 21, the communication adapter 150 needs to be oriented such that the communication cable 153 is clear of the positioning support plate 27, in other words, such that the cable outlet 152 does not face the positioning support plate 27. This helps to ensure that during assembly and during maintenance, the communication adapter 150 is allowed to be stored in the securing and storage part 21 in a proper orientation.

According to the embodiment, the communication cable 153 is attached to the binding band 154, and the binding band 154 is received in the band-position retaining part 28. This prevents the communication cable 153 from being displaced in the top-bottom direction of the indoor unit 1. Further, the band-position retaining part 28 is covered with the cover 22. Thus, the binding band 154, and a portion of the communication cable 153 to which the binding band 154 is attached are prevented from becoming dislodged from the band-position retaining part 28. This helps to ensure that inadvertent application of tension to the communication cable 153 does not cause pulling out of the communication cable 153 from the electrical component box 70 and a consequent poor connection of the communication cable 153 with the control board mounted inside the electrical component box 70.

According to the embodiment, with the communication adapter 150 temporarily placed on the temporary placement part 110, the base face 150A and the base face 150E are partially exposed from below the first rib 112 and from valley parts of the second rib 113. This makes it easy to place fingers on the base face 150A and the base face 156E of the communication adapter 150 to facilitate mounting and removal of the communication adapter 150 to and from the temporary placement part 110.

In the foregoing description of the embodiment, the temporary placement part 110 and the cable securing part 120 are disposed on the front of the dew-flying prevention component 100. However, this is not intended to be limiting. Alternatively, the temporary placement part 110 and the cable securing part 120 may be components separate from the dew-flying prevention component 100.

In the foregoing description of the embodiment, the temporary placement part 110 includes the first rib 112, the second rib 113, and the third rib 114. However; this is not intended to be limiting. The temporary placement part 110 may be any support structure where the communication adapter 150 can be temporarily placed such that mounting and removal of the communication adapter 150 to and from the temporary placement part 110 are facilitated.

In the foregoing description of the embodiment, the communication adapter 150 is temporarily placed on the temporary placement part 110 in a longitudinal orientation, and secured to the securing and storage part 21 in a lateral orientation. However, this is not intended to be limiting. The temporary placement of the communication adapter 150 may be performed in a lateral orientation, and securing of the communication adapter 150 may be performed in a longitudinal orientation. Alternatively, both the temporary placement and securing of the communication adapter 150 may be performed in a lateral orientation, or both the temporary placement and securing of the communication adapter 150 may be performed in a longitudinal orientation.

In the foregoing description of the embodiment, the communication adapter 150 is disposed such that the base face 150A and the base face 150E extend in a direction parallel to the front-back direction of the indoor unit 1. However, this is not intended to be limiting. The communication adapter 150 may be disposed such that the base face 150A and the base face 150B extend in a direction parallel to the lateral direction of the indoor unit 1.

In the foregoing description of the embodiment, the temporary placement part 110 is disposed on the front of the dew-flying prevention component 100, and located near a right end portion of the indoor unit 1. However, this is not intended to be limiting. The temporary placement part 110 may be located at the center of the indoor unit 1, or near a left end portion of the indoor unit 1.

In the foregoing description of the embodiment, the temporary placement part 110 is disposed on the front of the dew-flying prevention component 100, and the temporary placement part 110 is exposed from the opening 20A of the front housing 20 and covered with the cover 22. However, this is not intended to be limiting. Depending on where the temporary placement part 110 is disposed, and how the temporary placement part 110 is positioned relative to nearby components, a component for covering the temporary placement part 110 may not be provided.

REFERENCE SIGNS LIST

1: indoor unit, 1A: air inlet, 1B: air outlet, 10: rear housing, 20: front housing, 20A: opening, 20B: receiving part, 21: securing and storage part, 21A: upper face, 21B: lower face, 21C: lateral face, 21D: bottom face, 22: cover, 221: body, 222: hook-forming part, 222A: hook, 2223: hook, 223: screw fastening part, 223A: screw hole, 224: screw, 23: support part, 24: support part, 25: support part, 26: support part, 27: positioning support plate, 28: band-position retaining part, 281: wall face, 281A: cutout, 282: wall face, 282A: cutout, 30: front design panel, 40: air outlet structure, 41: drain pan, 42: air-passage defining component, 50: heat exchanger, 51: heat transfer tube, 52: connecting pipe, 60: fan, 70: electrical component box, 80: fan motor, 81: lower holder, 82: upper holder, 90: up-down air deflector, 100: dew-flying prevention component, 101: face, 110: temporary placement part, 111: side wall part, 112: first rib, 112A: laterally supporting part, 112B: longitudinally supporting part, 113: second rib, 113A: laterally supporting part, 113AA: first ridge part, 113AB: second ridge part, 113AC: third ridge part, 113AD: first valley part, 113AE: second valley part, 113B: longitudinally supporting part, 114: third rib, 120: cable securing part, 121: first cable-support plate, 122: second cable-support plate, 150: communication adapter, 150A: base face, 150B: base face, 1500: lateral face, 1500: lateral face, 150E: lateral face, 152: cable outlet, 153: communication cable, 154: binding band

The invention claimed is:

1. An indoor unit of an air-conditioning apparatus, the indoor unit comprising:

a rear housing in which a heat exchanger and an electrical component box are disposed;

a front housing disposed in front of the heat exchanger, the front housing being mounted to the rear housing such that the front housing is removable from the rear housing;

a front design panel disposed in front of the front housing, the front design panel being mounted to the front housing such that the front design panel is removable from the front housing;

a securing and storage part into which a communication adapter is secured, the communication adapter being used for communication with an external device, the securing and storage part being exposed when the front design panel is removed; and a temporary placement part on which to temporarily place the communication adapter, the temporary placement part being disposed at a location different from a location of the securing and storage part, wherein the temporary placement part is disposed between the electrical component box and an end portion of the heat exchanger near the electrical component box, and the front housing has an opening positioned to face the temporary placement part.

2. The indoor unit of an air-conditioning apparatus of claim 1, the indoor unit comprising a dew-flying prevention component that prevents a water droplet generated on a heat transfer tube from flying toward a front portion of the indoor unit, the heat transfer tube being exposed from an end portion of the heat exchanger, wherein the dew-flying prevention component is disposed between the electrical component box and the end portion of the heat exchanger near the electrical component box, and wherein the temporary placement part is disposed on a front face of the dew-flying prevention component.

3. The indoor unit of an air-conditioning apparatus of claim 2, wherein the securing and storage part is disposed in a portion of the front housing above the dew-flying prevention component.

4. The indoor unit of an air-conditioning apparatus of claim 2, the indoor unit comprising:

the communication adapter;

a communication cable connected to the communication adapter; and a band-position retaining part disposed in the front housing, the band-position retaining part being located on a path along which the communication cable is routed between the communication adapter secured in the securing and storage part and the electrical component box, wherein a binding band is attached to a portion of the communication cable routed from the communication adapter to the electrical component box, wherein with the communication adapter secured in the securing and storage part, the binding band is received in the band-position retaining part, and wherein the band-position retaining part is a box-shaped recess and has a pair of wall faces facing each other in a top-bottom direction of the indoor unit and preventing displacement of the binding band in the top-bottom direction of the indoor unit.

5. The indoor unit of an air-conditioning apparatus of claim 1, the indoor unit comprising a removable cover that covers the opening.

* * * * *